US006712396B2

(12) United States Patent
Derraugh

(10) Patent No.: US 6,712,396 B2
(45) Date of Patent: Mar. 30, 2004

(54) SOFT BOOK

(76) Inventor: William Derraugh, 35 Rogues Ridge Rd., Weston, CT (US) 06883

( * ) Notice: Subject to any disclaimer, the term of this patent is extended or adjusted under 35 U.S.C. 154(b) by 0 days.

(21) Appl. No.: 10/154,451

(22) Filed: May 21, 2002

(65) Prior Publication Data

US 2003/0042730 A1 Mar. 6, 2003

Related U.S. Application Data

(63) Continuation-in-part of application No. 09/886,161, filed on Jun. 20, 2001, now Pat. No. 6,390,507.

(51) Int. Cl.[7] ..... B42D 1/00

(52) U.S. Cl. ..... 281/38; 281/29; 281/51; 281/21.1; 283/63.1; D19/26; D19/33; D19/34; 434/433

(58) Field of Search ..... 281/29, 31, 15.1, 281/21.1, 36, 37, 38; 283/63.1, 61, 64; D19/26, 33, 34; 434/433

(56) References Cited

U.S. PATENT DOCUMENTS 4,280,241 A * 7/1981 Pfaff ..... 281/29
6,364,360 B1 * 4/2002 Kaufman ..... 281/15.1

* cited by examiner

*Primary Examiner*—Willmon Fridie, Jr.
(74) *Attorney, Agent, or Firm*—Tope-McKay & Associates

(57) ABSTRACT

A soft book comprised of foam pages bound by a book binding portion and a plurality of page binding portions is presented. A front cover page, a rear cover page, and at least one page, each having a perimeter, are provided, with the pages forming a spine portion, with the book bound such that at least a portion of the perimeter each page is approximately flush with the binding portions. The pages of the book may include impressions or cutouts that may be made in various shapes. Cutouts may provide a puzzle-type game for children. Various binding materials may be used, preferably chosen to provide sufficient support for the flexible foam pages.

27 Claims, 8 Drawing Sheets

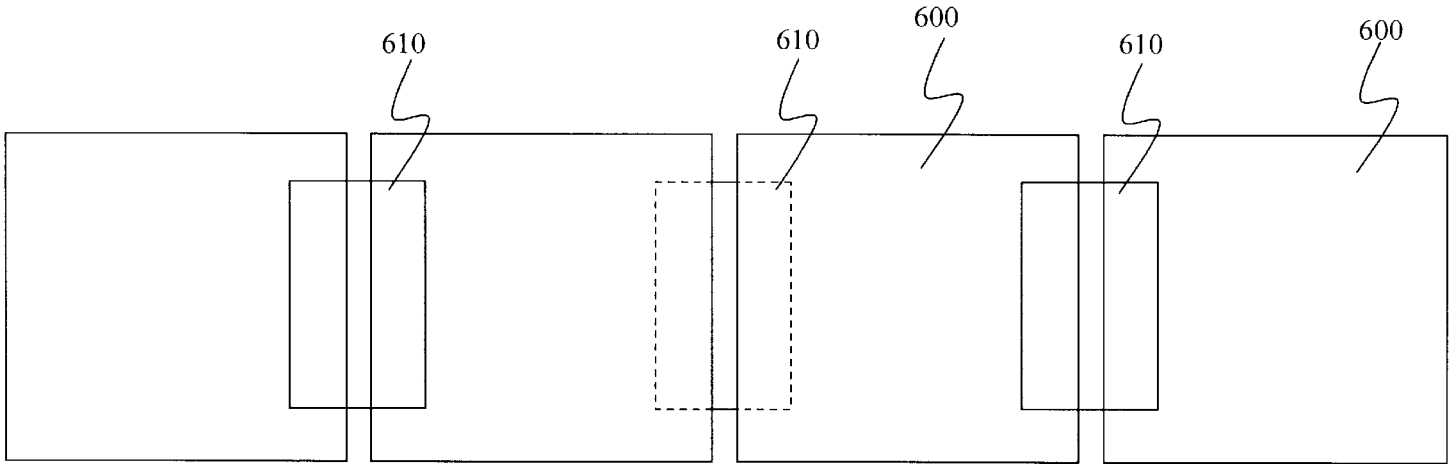
FIG. 6(c)(1)
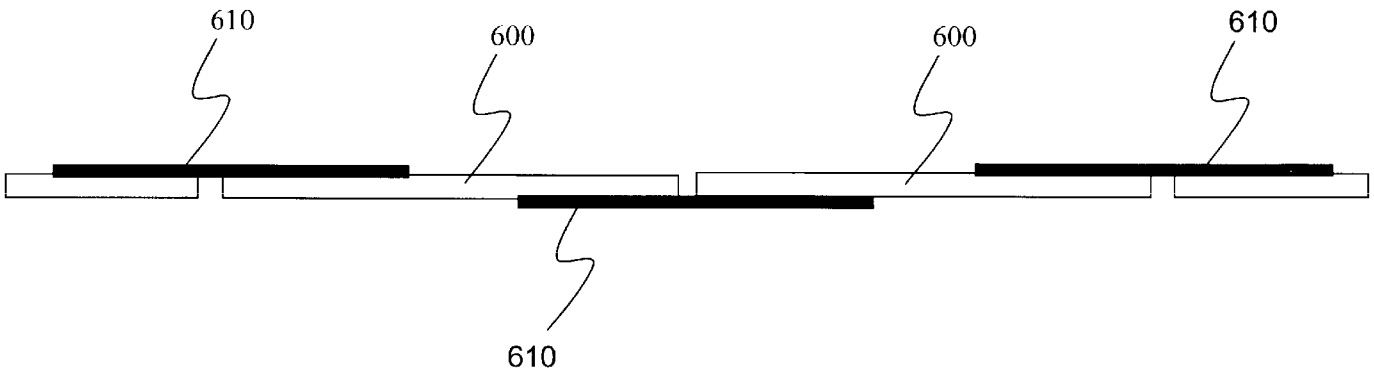
FIG. 6(c)(2)

SOFT BOOK

RELATED APPLICATIONS

The present invention is a continuation in-part of U.S. patent application Ser. No. 09/886,161, now U.S. Pat. No. 6,390,507, issued May 21, 2002.

TECHNICAL FIELD

The present invention relates generally to books and more particularly to a book comprised of, and bound by, a flexible and supportive material.

BACKGROUND OF THE INVENTION

Reading materials in general and books specifically, have existed for thousands of years. New materials have been developed since the time of papyrus, and have been utilized in the construction and binding of reading materials. Books have traditionally been produced utilizing paper for the pages and thicker paper or cardboard for the covers. These materials can be extremely heavy, unwieldy, and in the case of children, can create the risk of injury due to lacerations and abrasions. Several patents have contemplated replacing these traditional materials with alternatives for both page and cover. U.S. Pat. No. 4,280,241 discloses a book construction technique in which the pages are constructed of cloth, and filled with plastic or rubber. While that patent discloses a book construction by surrounding soft rubber with a cloth material, a multitude of difficulties are presented. Cloth is a material with considerable limitations. These limitations are due in part from cloth's limited durability. Cloth must be sewn into or printed onto in order to create suitable reading material. Additionally, the construction technique required to construct the above book, mandated the use of sewing needles and thread.

A children's book comprised of foam leaves is disclosed in U.S. Pat. No. 6,070,909. While recognizing the benefits of foam construction, the '909 patent contemplates the absence of a cover material in order to create a book that is washable, and that may be used in a bathing environment. Additionally, the '909 patent contemplates the die cutting of foam parts from the leaves of the books as puzzle pieces. However, without additional support, foam is highly malleable and easily deformed due to changes in pressure or heat.

Therefore, a need exists in the art to provide a book suitable for small children which has pages constructed of a soft foam material, is bound with a flexible and supportive material, and is easily die cut.

SUMMARY OF THE PRESENT INVENTION

The present invention relates generally to books and more particularly to foam materials and methods for binding.

These and other advantages of the present invention will be made more apparent with reference to the detailed description and the drawings provided herein.

BRIEF DESCRIPTION OF DRAWINGS

FIG. 1(*b*) is a side view of a page of a soft book showing the relationship between the foam and the binding portion;

FIG. 6(*b*) is a perspective view of a plurality of pages according to the present invention, to which a concertina-type ring-binding is applied;

FIG. 6(*c*)(1) is a side view of four pages bound in a concertina-type fashion according to the present invention, using binding patches as a binding means; and FIG. 6(*c*)(2) is a top view of the embodiment of FIG. 6(*c*)(2).

DETAILED DESCRIPTION

Figure 1B:
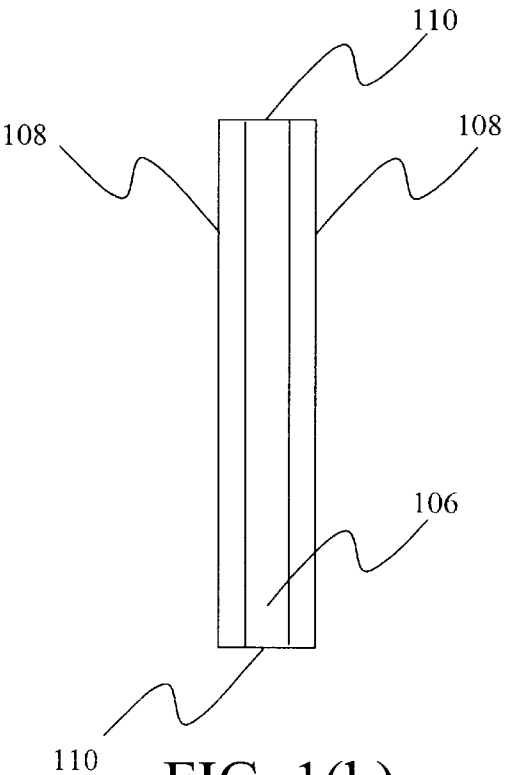
FIG. 1(*a*) is a front view of a soft book with front cover.

The present invention provides a book comprised of, and bound by, a flexible and supportive material which may be tailored to a variety of applications. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

The present invention provides a novel and useful soft book. An embodiment of the device of the present invention is presented in FIG. 1(*a*). A front cover 100 having a perimeter and substantially comprised of foam is shown, as well as a book-binding portion 102 fixedly attached to, and covering, at least a portion of the front cover 100. The perimeter 104 of the front cover page 100 is preferably flush with the binding 102. However, depending on the needs of a particular embodiment, the relationship of the perimeter 104 of the front cover page 100 may be approximate with respect to the binding 102, either falling short of the binding 102 by about ½ inch or extending beyond the binding 102 by up to about a half-inch. The book binding portion 102 is comprised of a flexible and supportive material. Non-limiting examples of binding materials include paperboard, laminated paperboard, plastic, and cloth. Note that the front cover 100 shown in FIG. 1(*a*) may also represent any other page of a foam book.

The front cover 100 is a leaf comprised of a foam material, which provides rigidity, printability and usability. In the preferred embodiment, all foam utilized in the present invention is comprised of ethyl vinyl acetate (EVA). EVA as a material is soft, very easily manufactured into various shapes and thickness, and is rugged and sturdy making it a good material for children's books whose pages prone to ripping.

Figure 1A:
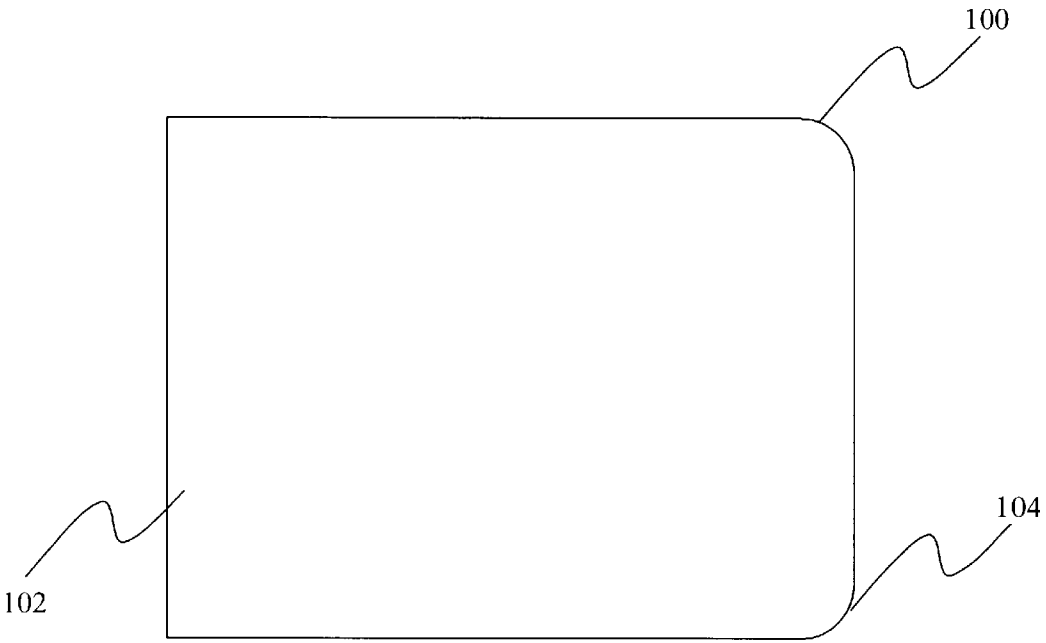

A side view of a page of the soft book is shown in FIG. 1(*b*), more clearly depicting the relationship between a foam page (leaf) 106 and a pair of binding (support) portions 108. This page may represent a cover page, such as the front cover 100, or one of possibly several pages between two cover pages. The binding portions 108 may represent a bookbinding portion or a page binding portion. In FIG. 1(*b*), the perimeter 110 of the page shows a flush relationship between the foam page 106 and each of the pair of binding portions 108 though, as previously mentioned, this relationship may be approximate. Note that an individual binding portion 108 may be made to cover two foam pages 106 such that the pages are fixed to each other by the binding portion 108.

Figure 2:
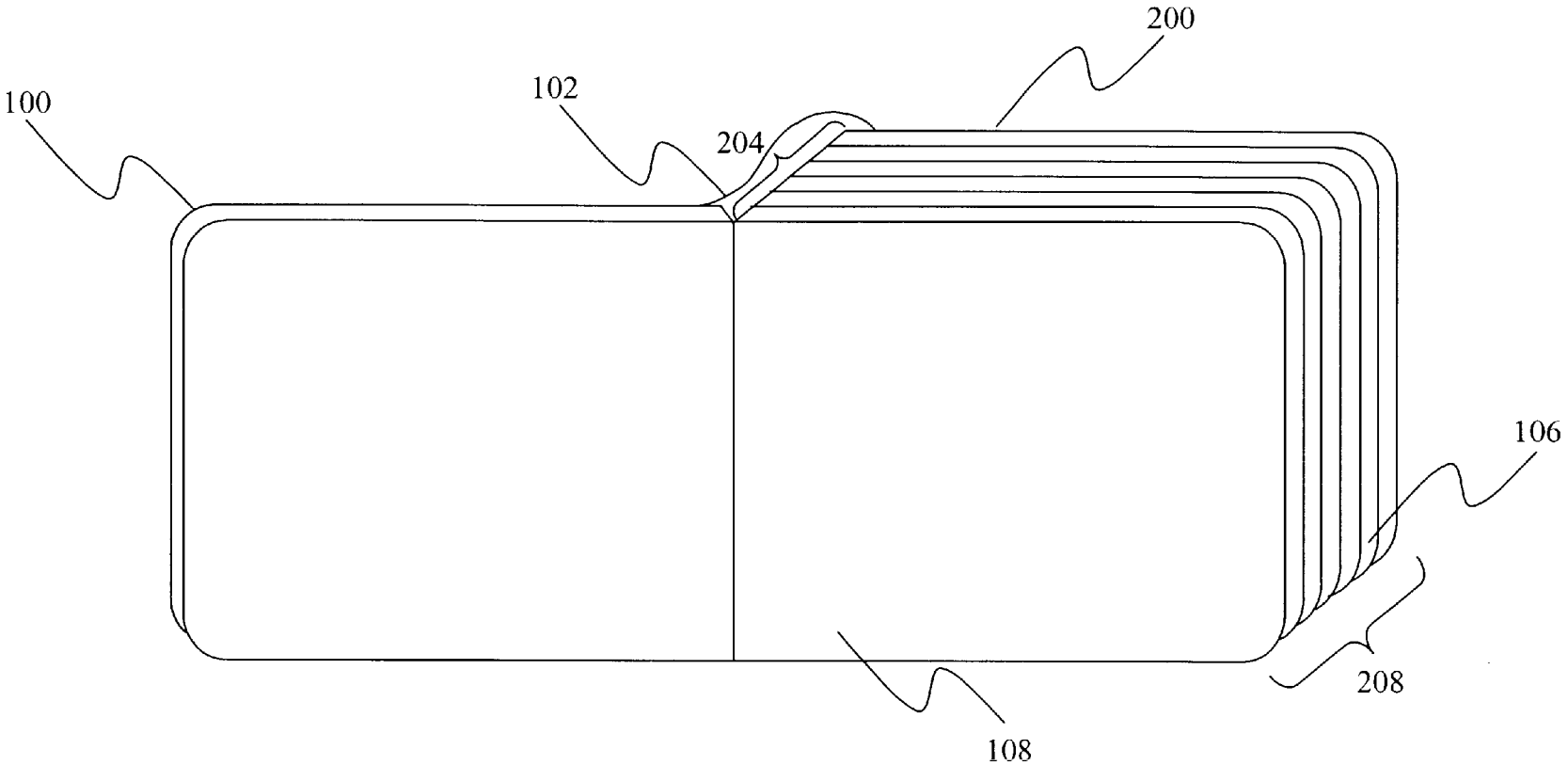
FIG. 2 is an open side view of the soft book in accordance with the present invention.

An open side view of the soft book is shown in FIG. 2. As can be seen in FIG. 2, the front cover 100 is open hingedly and the book binding portion 102 is fixedly attached thereto. A foam page 106 is shown, where an edge of a set of multiple pages comprises a spine 204, which is covered by the book binding portion 102. The book binding portion 102 is fixedly attached to both the front cover 100 and a rear cover 200. The book binding portions 102, and the page binding portions 206, may be attached by one of many means, non-limiting examples of which include glue, resin, paste and adhesives. At the outermost portion of each page 106, the page binding portions 206 are approximately flush with the foam pages 106. Depending on the specific embodiment, however, the page binding portions 206 may fall short of or may extend beyond the foam pages 106, thereby varying the composition of the perimeter 108 of the book. The foam pages 106 are fixedly attached with each other by the page binding portion 206. One page binding portion 206 resides between each pair of pages 106. A plurality of the page binding portions 206 attach with and cover the pages 106 such that the perimeter of each of the pages is approximately flush with (e.g. falls just short of, is flush with, or extends slightly beyond) the page binding portion 206. Both the book binding portion 106 and the page binding portions 206 attach to allow the pages 106 of the book to open and close, whereby the book binding portion 102 and the plurality of page binding portions 206 serve to bind all of the pages 102 of the book together and allow for opening and closing the book. The page binding portions 206 are comprised of a flexible and supportive material, non-limiting examples of which include paperboard, laminated paperboard, plastic, and cloth.

Figure 3:
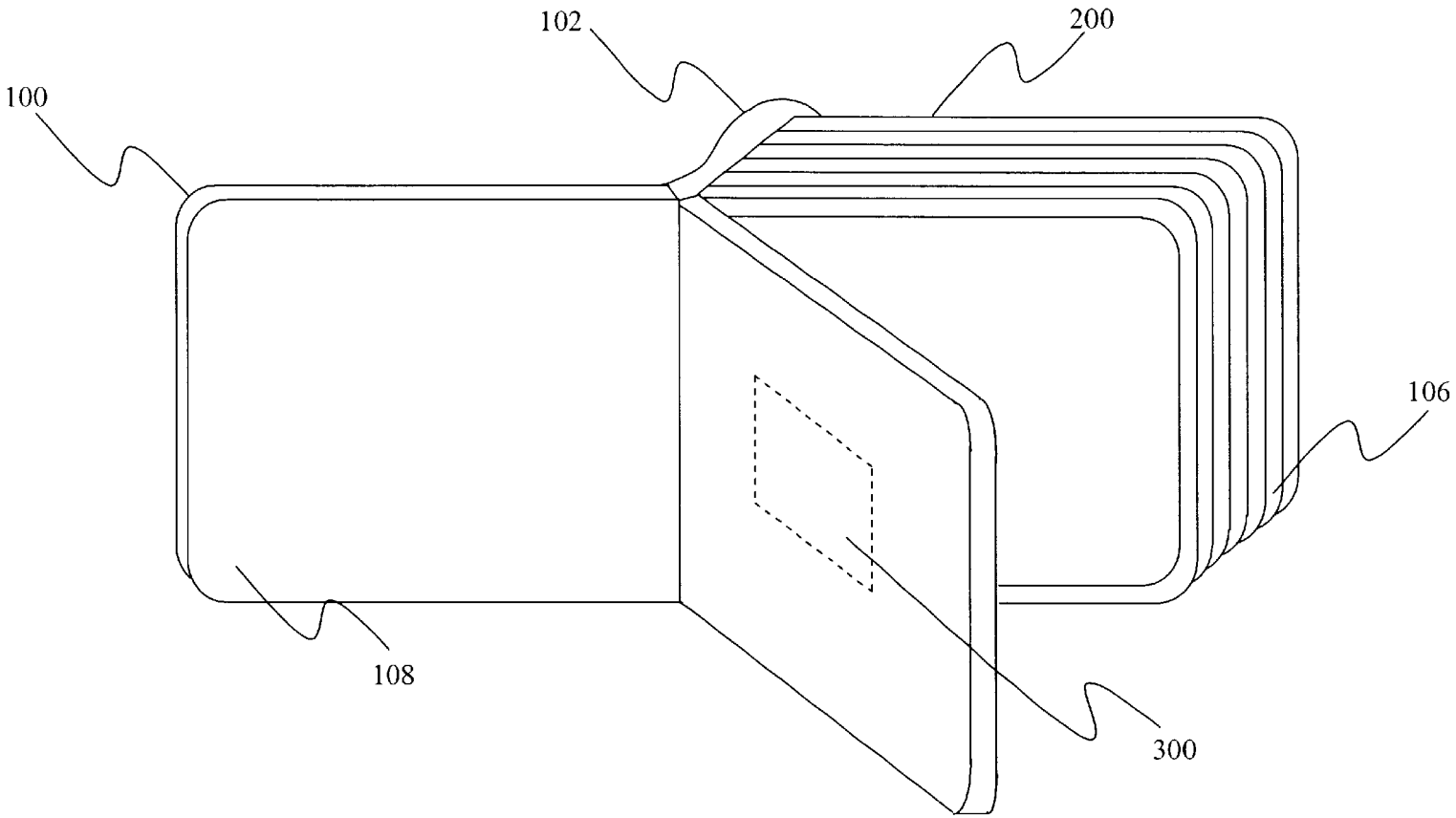
FIG. 3 is an open side view of the soft book with a die impressed page.

An open side view of soft book and die cut page is shown in FIG. 3. As can be seen in FIG. 3, a shape 300 is impressed into the page 106. The shape 300 can be impressed or stamped to varying depths and for varying purposes non-limiting examples of which include words, shapes, and pictures.

Figure 4:
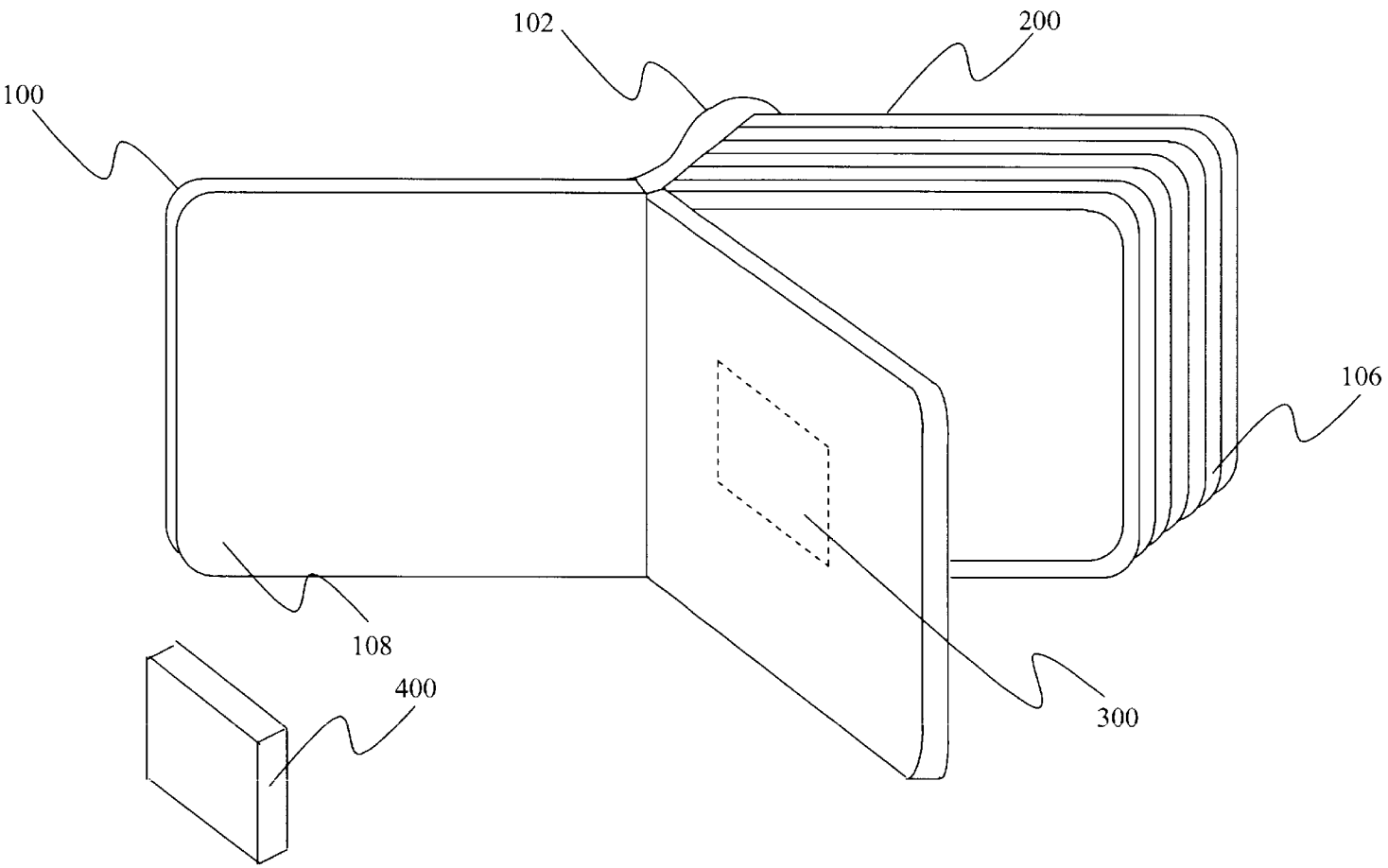
FIG. 4 is an open side view of the soft book with a die-cut page, with the die-cut piece removed in accordance with the present invention.

A open side view of the present invention is shown in FIG. 4. As can be seen in FIG. 4, the page portion 106 and the page binding portion 206 can be cut wholly through to form a cut-out shape 400. The cut-out shapes 400 may optionally be replaced into the portions of a page 106 where they are cut from. The cut-out shapes 400 can be cut in varying sizes, and may, for example, be cut in the shape of puzzle pieces. Due to the cut-out shapes 400 being cut from both the foam material that comprises the pages 106 and the flexible and supportive material that comprises the page binding portions 206, and the book binding portions 102, the cut-out shapes are sturdy and flexible.

In alternative embodiments, one or more of the page binding portions 206 may be comprised of an erasable writing surface. Additionally, the book binding portion 102 and the page binding portion 206 may be composed of differing materials. Although the preferred embodiment includes both book binding portions 102 and page binding portions 206, the book binding portion 102 may be omitted where the page binding portions provide adequately for the pages to remain attached.

Figure 5:
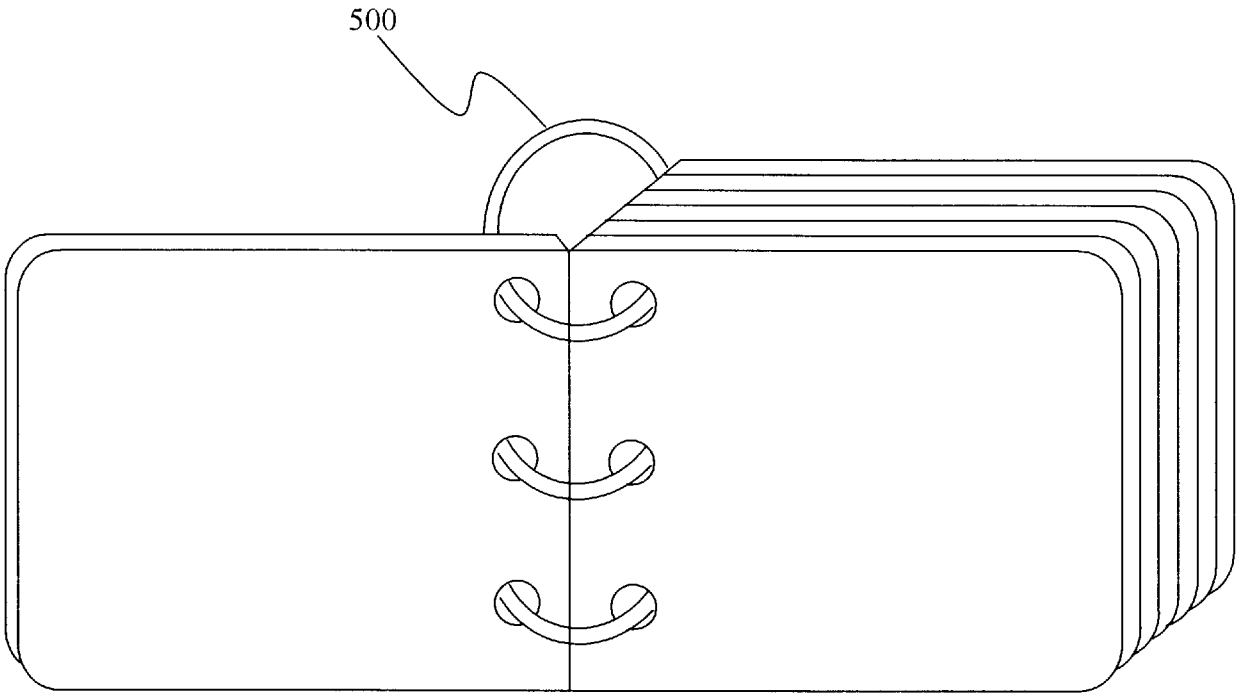
FIG. 5 is an open side view of the soft book in accordance with the present invention, in which a ring-binding is used.

In a still further embodiment, the binding technique used may be a ring-type binding as shown in FIG. 5, where a plurality of pages as depicted in FIG. 1(*a*) and FIG. 1(*b*) are bound using loops 500. "Ring-type binding" as used herein includes any binding mechanism where the pages are held together by a loop of material. The loop may be permanently closed, such as through the use of a solid ring of metal or plastic, a fused strip of rubber, or a sewn strip of cloth. Alternatively, the loop may be non-permanently closed, such as through the use of tied strings or vinyl or a metal or plastic ring that may be opened and closed.

Figure 6A:
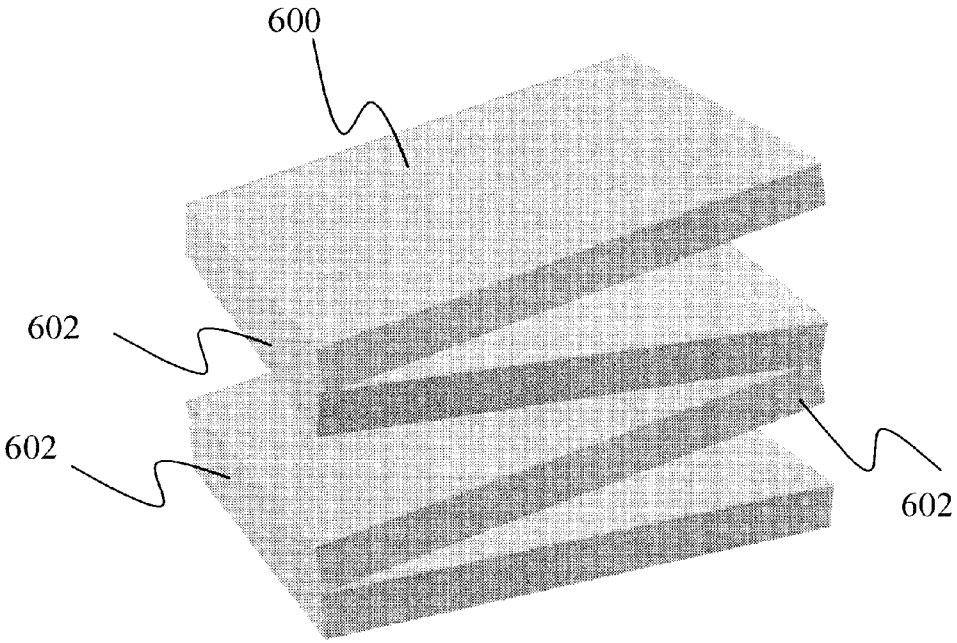
FIG. 6(*a*) is a perspective view of a plurality of pages according to the present invention, to which a concertina-type binding is applied.
Figure 6B:
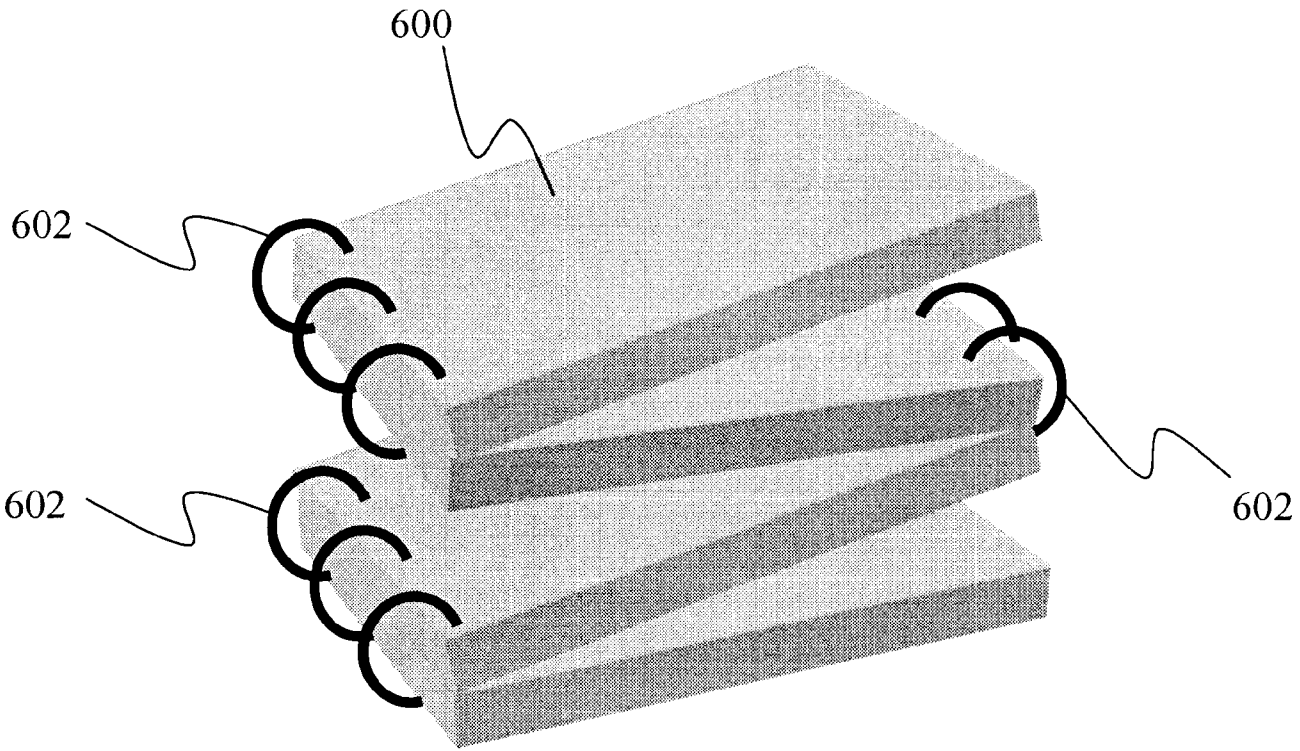

In another embodiment, the binding technique used may allow for concertina-type opening of the pages. FIG. 6(*a*) shows a plurality of pages 600, of the type depicted in FIG. 1(*a*) and FIG. 1(*b*), partially opened in a concertina-type fashion. Binding means 602 are provided at opposite sides of the pages in order to provide the proper opening mechanism. FIG. 6(*b*) is a view similar to that of FIG. 6(*a*), in which the binding means are loops like those depicted in FIG. 5. FIG. 6(*c*) shows an alternative binding mechanism for producing a concertina-type book, in which FIG. 6(*c*)(1) is a side view of four pages 600 with alternating binding patches 610. FIG. 6(*c*)(2) is a top view of the book shown in FIG. 6(*c*)(1). The binding patches 610 may be formed to function as the binding portions 108, and may be enlarged beyond the size shown so that the overall perimeter of each binding portion 108 approximates the combined perimeter of two pages 600. The alternating binding patches may be formed of any flexible and durable material, non-limiting examples of which include cloth and rubber strips. A wide variety of potential binding mechanisms for concertina-type binding may be used, some of which may be seen in co-pending U.S. patent application Ser. No. 09/997,189, titled "Foam Book With Concertina Binding", filed on Nov. 20, 2001 and incorporated herein by reference.

The pages of the soft book of the present invention may be cut (preferably die cut) in any desired shape, non-limiting examples of which include houses and animals. This cutting may be performed on all of the pages as a group or on individual pages. The resulting cut set of pages then may be combined into a shaped soft book.

What is claimed is:

1. A foam book comprising:

a front cover page having a perimeter and substantially comprised of foam;

a rear cover page having a perimeter and substantially comprised of foam;

at least one page having a perimeter and residing between the front cover page and the rear cover page, the at least one page substantially comprised of foam; the front cover page, the rear cover page, and the at least one page together forming pages of a foam book including a spine and a perimeter;

a book binding portion fixedly attached with and covering the spine of the foam book and a portion of the front cover page and the rear cover page such that at least a portion of the perimeter of the front cover page and the rear cover page is approximately flush with the binding; and a plurality of page binding portions, with one page binding portion residing between each pair pages, attached with, and covering the pages such that at least a portion of the perimeter each of the pages is approximately flush with the page binding portion, with both the book binding portion and the page binding portions attached to allow the pages of the book to open and close; whereby the book binding portion and the plurality of page binding portions serve to bind all of the pages of the book together and allow for opening and closing the pages.

2. A foam book as set forth in claim 1, wherein the book binding portion and the page binding portions are comprised of a flexible and supportive material.

3. A foam book as set forth in claim 2, wherein at least one shape is stamped into at least one of the book binding portion and page binding portions and into the foam of the pages covered thereby in order to form impression-type shapes in the pages.

4. A foam book as set forth in claim 2, wherein the book binding portion and the page binding portions are comprised of a material selected from the group consisting of paperboard, laminated paperboard, plastic, and cloth.

5. A foam book as set forth in claim 4, wherein portions of at least one of the front cover page, the rear cover page, the at least one page therebetween, the book binding portion, and the page binding portions are cut partially or wholly through to form cut-out shapes therefrom.

6. A foam book as set forth in claim 5, wherein the cut-out shapes may be replaced into the portions of the at least one of the front cover page, the rear cover page, the at least one page therebetween, the book binding portion, and the page binding portions where they were cut from.

7. A foam book as set forth in claim 6, wherein the cut-out shapes are in the form of puzzle pieces.

8. A foam book as set forth in claim 1, wherein at least one of the book binding portion and the page binding portions are comprised of a material that forms an erasable writing surface.

9. A foam book as set forth in claim 1, wherein the book binding portion and the page binding portions are comprised of mutually different materials.

10. A foam book comprising:

a front cover page having a perimeter and substantially comprised of foam;

a rear cover page having a perimeter and substantially comprised of foam;

at least one page having a perimeter and residing between the front cover page and the rear cover page, the at least one page substantially comprised of foam;

the front cover page, the rear cover page, and the at least one page together forming pages of a foam book including a perimeter; and a plurality of page binding portions, with one page binding portion residing between each pair pages, attached with, and covering the pages such that at least a portion of the perimeter each of the pages is approximately flush with the page binding portion, with page binding portions attached to allow the pages of the book to open and close; whereby the plurality of page binding portions serve to bind all of the pages of the book together and allow for opening and closing the pages.

11. A foam book as set forth in claim 10, wherein the page binding portions are comprised of a flexible and supportive material.

12. A foam book as set forth in claim 11, wherein at least one shape is stamped into at least one of the page binding portions and into the foam of the pages covered thereby in order to form impression-type shapes in the pages.

13. A foam book as set forth in claim 11, wherein the page binding portions are comprised of a material selected from the group consisting of paperboard, laminated paperboard, plastic, and cloth.

14. A foam book as set forth in claim 13, wherein portions of at least one of the front cover page, the rear cover page, the at least one page therebetween, and the page binding portions are cut partially or wholly through to form cut-out shapes therefrom.

15. A foam book as set forth in claim 14, wherein the cut-out shapes may be replaced into the portions of the at least one of the front cover page, the rear cover page, the at least one page therebetween, and the page binding portions where they were cut from.

16. A foam book as set forth in claim 15, wherein the cut-out shapes are in the form of puzzle pieces.

17. A foam book as set forth in claim 10, wherein at least one of the page binding portions is comprised of a material that forms an erasable writing surface.

18. A page for a foam book comprising:

a leaf substantially comprised of foam and including two opposite side, with each of the opposite sides bounded by a perimeter; and at least one support portion having two opposite sides, with each of the opposite sides bounded by a perimeter, with the perimeter of the support portion approximately the same as the perimeter of the leaf, with each support portion fixedly attached at one side with a side of the leaf.

19. A page for a foam book as set forth in claim 18, wherein the page comprises two support portions, each fixedly attached to a different side of the leaf.

20. A ring-bound foam book comprising:

a plurality of leaves substantially comprised of foam and including two opposite sides, with each of the opposite sides of each leaf bounded by a perimeter;

at least one support portion corresponding to each of the leaves, with each support portion including two opposite sides, with each of the opposite sides bounded by a perimeter, with the perimeter of the support portion approximately the same as the perimeter of the corresponding leaf, the support portion fixedly attached at one side with a side of the corresponding leaf; and a ring-type binding applied through the plurality of pages, whereby the plurality of pages may open and close.

21. A ring-bound foam book as set forth in claim 20, wherein the ring-type binding is selected from a group consisting of metal rings, vinyl strings, cloth strips, and rubber strips.

22. A ring-bound foam book as set forth in claim 20, where the ring-type binding is applied in a concertina-type fashion.

23. A ring-bound foam book as set forth in claim 20, wherein the ring-type binding is selected from a group consisting of metal rings, vinyl strings, cloth strips, and rubber strips.

24. A concertina-bound foam book comprising:

a plurality of leaves substantially comprised of foam and including two opposite sides, with each of the opposite sides of each leaf bound by a perimeter;

at least one support portion corresponding to each of the leaves, with each support portion including two opposite sides, with each of the opposite sides bound by a perimeter, with the perimeter of the support portion approximately the same as the perimeter of the corresponding leaf, the support portion fixedly attached at one side with a side of the corresponding leaf; and a binding means applied to the plurality of pages such that the pages open and close in a concertina-type fashion.

25. A foam book portion comprising:

a first page having a perimeter and substantially comprised of foam;

a last page having a perimeter and substantially comprised of foam;

at least one page having a perimeter and residing between the first page and the last page, the at least one page substantially comprised of foam; the first page, the last page, and the at least one page together forming pages of a foam book including a spine and a perimeter;

a book binding portion fixedly attached with and covering the spine of the foam book and a portion of the first page and the last page such that at least a portion of the perimeter of the first page and the last page is approximately flush with the binding; and a plurality of page binding portions, with one page binding portion residing between each pair pages, attached with, and covering the pages such that at least a portion of the perimeter each of the pages is approximately flush with the page binding portion, with both the book binding portion and the page binding portions attached to allow the pages of the book to open and close; whereby the book binding portion and the plurality of page binding portions serve to bind all of the pages of the book together and allow for opening and closing the pages.

26. A foam book comprising a plurality of bound pages, with at least a portion of the bound pages each including:

a leaf substantially comprised of foam and including two opposite side, with each of the opposite sides bounded by a perimeter; and at least one support portion having two opposite sides, with each of the opposite sides bounded by a perimeter, with the perimeter of the support portion approximately the same as the perimeter of the leaf, with each support portion fixedly attached at one side with a side of the leaf.

27. A foam book as set forth in claim 26, wherein each page comprises two support portions, each fixedly attached to a different side of the leaf.

* * * * *